United States Patent [19]

Golas et al.

[11] 4,199,087

[45] Apr. 22, 1980

[54] APPARATUS FOR INJECTION OF INERT GAS TO PREVENT SUPERSPEED EFFECT

[75] Inventors: Eugene A. Golas, Middletown Township, Bucks County; William A. Sech, Lower Makefield Township, Bucks County; Shri N. Singh, Penn Township, Westmoreland County, all of Pa.

[73] Assignee: United States Steel Corporation, Pittsburgh, Pa.

[21] Appl. No.: 872,272

[22] Filed: Jan. 25, 1978

[51] Int. Cl.[2] ..... B22D 37/00; B22D 11/10

[52] U.S. Cl. ..... 222/603; 164/415; 164/437; 164/133; 222/600

[58] Field of Search ..... 164/4, 82, 133, 66, 164/415, 449, 155, 413, 437; 222/603, 600

[56] References Cited

U.S. PATENT DOCUMENTS

| | | | |
|---|---|---|---|
| 3,253,307 | 5/1966 | Griffiths et al. | 222/603 X |
| 3,727,805 | 4/1973 | Shapland | 164/437 X |

*Primary Examiner*—Robert D. Baldwin
*Assistant Examiner*—Gus T. Hampilos
*Attorney, Agent, or Firm*—John F. Carney

[57] ABSTRACT

An apparatus for regulating the rate at which molten metal is supplied from a receiving vessel, through a pouring tube, to the mold of a continuous casting apparatus or the like. The described apparatus is particularly adapted to overcome irregularities that occur in the molten metal as it flows through the pouring tube, such irregularities being known as "superspeed effect". A method is also described for effectively using the disclosed apparatus.

4 Claims, 3 Drawing Figures

APPARATUS FOR INJECTION OF INERT GAS TO PREVENT SUPERSPEED EFFECT

BACKGROUND OF THE INVENTION

The production of slabs, blooms and billets by the continuous casting process is well known. By this process such metal products are cast directly from molten metal instead of being produced by the previously employed multi-step process involving the casting of ingots, soaking and rolling the ingots into shapes.

In the practice of the continuous casting process, molten metal is continuously teemed into an open-ended mold from a superposed vessel, commonly called a tundish. Simultaneously therewith, the cast product is continuously withdrawn from the bottom of the mold in the form of a solid metal shell whose interior remains liquid until sufficiently cooled for complete solidification.

Ideal casting conditions require that molten metal be teemed to the caster mold at the same rate at which the solid metal shell is removed therefrom. Thus, a close control is normally maintained both on the rate of withdrawal of the cast shell from the mold and on the rate of supply of molten metal from the tundish to the mold to hold the level of molten metal in the mold substantially constant. Control of the molten metal supply to the mold in such installations is commonly effected by means of a sliding gate valve operably disposed at the pour opening of the tundish. These valves, which are available in several known forms, control flow to the mold by varying the size of the flow opening through the valve either by altering the positional alignment of an aperture in the movable gate plate of the valve with respect to an aperture in a stationary top plate or by changing gates containing apertures of varying sizes.

It is usually desirable in such applications to protect the poured metal stream against the possibility of atmospheric reoxidation and splashing as it flows from the tundish to the mold. This is particularly desirable in instances where aluminum-killed steel is poured wherein occlusions of aluminum oxide are formed by exposure of the metal stream to air and result in the rapid plugging of the metal pour passage. A well known practice for avoiding this problem involves enclosing the metal stream within an elongated pouring tube that extends from the discharge side of the gate valve into the interior of the caster mold. Such apparatus are disclosed in U.S. Pat. No. 3,459,346, granted Aug. 5, 1969 to B. Tinnes and U.S. Pat. No. 3,502,134, granted Mar. 24, 1970 to M. A. Orehoski.

Obviously, in order to prevent the ingress of air into the pouring tubes such as those described in these patents an effective air-tight seal must be provided between the interior and exterior of the tubes. When the pouring tube is properly sealed, initiation of teeming into the mold causes the molten metal level in the mold to rise and immerse the discharge end of the pouring tube whereupon any air present within the tube is rapidly exhausted therefrom by entrainment in the metal stream. As air is evacuated from the pouring tube, the metal level therein rises until the tube interior is ultimately filled.

Although the total evacuation of air from the interior of the pour tube as evidenced by the complete filling thereof with molten metal is desirable from the standpoint of the prevention of contact of the flowing metal with air, it has been discovered that, when the aspiration of air into the pouring tube is minimized by a substantially gas-tight seal about the juncture between the pouring tube and the gate valve, the rate at which metal flows through the tube into the mold significantly and unexpectedly increases thereby requiring the removal of the cast shell from the mold bottom to be accelerated in order to maintain the metal level in the mold constant. This phenomenon is referred to as "superspeed effect".

The occurrence of the "superspeed effect" is undesirable in the practical operation of a continuous caster because of the difficulties it presents in controlling the speed at which the cast shell is withdrawn from the mold or, alternatively, the deleterious effect created on product quality when shell withdrawl speed is not accurately controlled. These adverse results of "superspeed effect" stem from the fact that, in actual practice, there is frequent movement between the mating plates of the gate valve which continually changes the effectiveness of the seal between the gate valve and the pouring tube. As the effectiveness of the seal is reduced, there is a corresponding reduction in the rate at which metal flows into the mold and, conversely, when the seal becomes more effective the rate of metal flow increases. The overall result, therefore, is to impose a greater burden on the shell withdrawal control apparatus.

It is to the alleviation of the above-mentioned problem, therefore, that the present invention is directed.

SUMMARY OF THE INVENTION

According to the present invention, there is provided in an organization for pouring molten metal at a controlled rate from a receptacle to the mold of a continuous caster including an elongated pouring tube extending between the discharge opening of the receptacle and the interior of the mold the method of regulating the rate of flow of molten metal from the receptacle to the mold including the steps of injecting a gaseous fluid, including but not limited to inert gases such as argon, nitrogen or the like, or reducing gases, such as methane, or other hydrocarbon-containing gases into the interior of the pouring tube and controlling the rate of flow of said fluid in response to the rate of flow of molten metal from said pouring tube.

According to another aspect of the invention, there is provided in an organization for delivering molten metal to the mold of a continuous caster comprising a receptacle containing a molten metal and having a bottom pour opening therefrom, a sliding gate valve operatively disposed with respect to said bottom pour opening including a pair of vertically spaced stationary plates having aligned openings in alignment with said bottom pour opening and a movable gate plate having an aperture adapted to be aligned with said aforementioned openings for passing molten metal to said mold, and an elongated pouring tube extending between the lowermost of said stationary plates and the interior of said mold, the improvement comprising said lowermost stationary plate including a refractory plate, means on the lower surface of said plate for attaching one end of said pouring tube with its interior in alignment with the opening in said plate, and means for conducting a gaseous fluid through said plate from an external source to the juncture between said pouring tube end and said plate.

For a better understanding of the invention, its operating advantages and the specific objectives obtained by its use, reference should be made to the accompanying drawings and description which relate to a preferred embodiment thereof.

PREFERRED EMBODIMENT OF THE INVENTION

Figure 1:
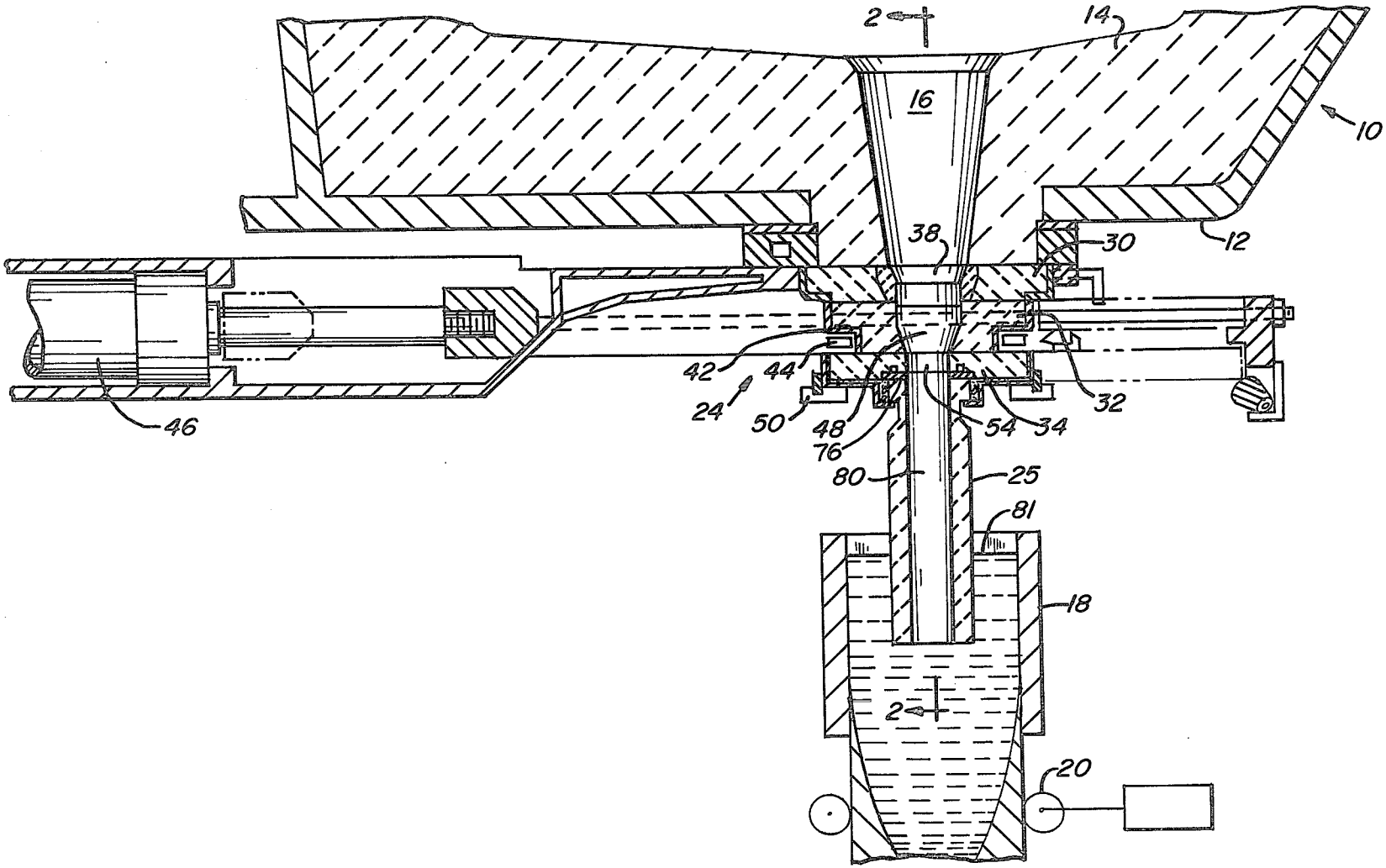
FIG. 1 is a sectional view of a portion of a metal receiving vessel that is equipped with a sliding gate valve with attached pouring tube adapted to perform in accordance with the present invention.

In the drawings, there is shown the lower portion of a molten metal receiving vessel 10, such as a tundish, comprising a metal casing 12 and refractory lining 14 provided with a bottom opening 16. The vessel 10 is shown as being operably positioned over a mold 18 forming part of a continuous caster organization. A pair of oppositely spaced drive rolls 20 located below the mold 18 schematically illustrate the means employed for controllably withdrawing the cast metal product, or shell, from the mold, all as is well known in the art. The drawings further depict one form of sliding gate valve, generally indicated as 24, contemplated for use in the present invention and having means for attaching a pouring tube 25 that extends between the bottom of the valve and the interior of the mold 18.

The sliding gate valve 24 illustrated in these drawings is as shown and completely described in U.S. Pat. No. 3,727,805, granted Apr. 17, 1973 to J. T. Shapland and assigned to the assignee hereof. The description contained in that patent is incorporated by reference in this application to the extent required for an understanding of the invention herein.

The sliding gate valve 24 consists essentially of a frame 26 attached to the vessel casing 12 by means of mounting plate 28 and being adapted to maintain three vertically spaced refractory plates termed the stationary plate 30, the gate plate 32 and the pouring tube support plate 34 in their respective operative positions in relation to the vessel opening 16. The stationary plate 30 is a generally rectangular metal-encased refractory plate that is received in a recess 36 in the frame 26 and contains a central opening 38 that is vertically aligned with the vessel opening 16. The gate plate 32 is, similarly, a generally rectangular, metal-encased refractory plate, but is slightly smaller dimensionally than the stationary plate 30. The gate plate 32 is formed on its underside with a peripherally extending stepped shoulder 42 for engagement with the inboard ends of oppositely spaced, spring biased levers 44 pivotally attached to the frame 26 that retain the plate member for sliding movement and urge it into tight surface-to-surface contact with the bottom surface of the stationary plate 30.

Figure 2:
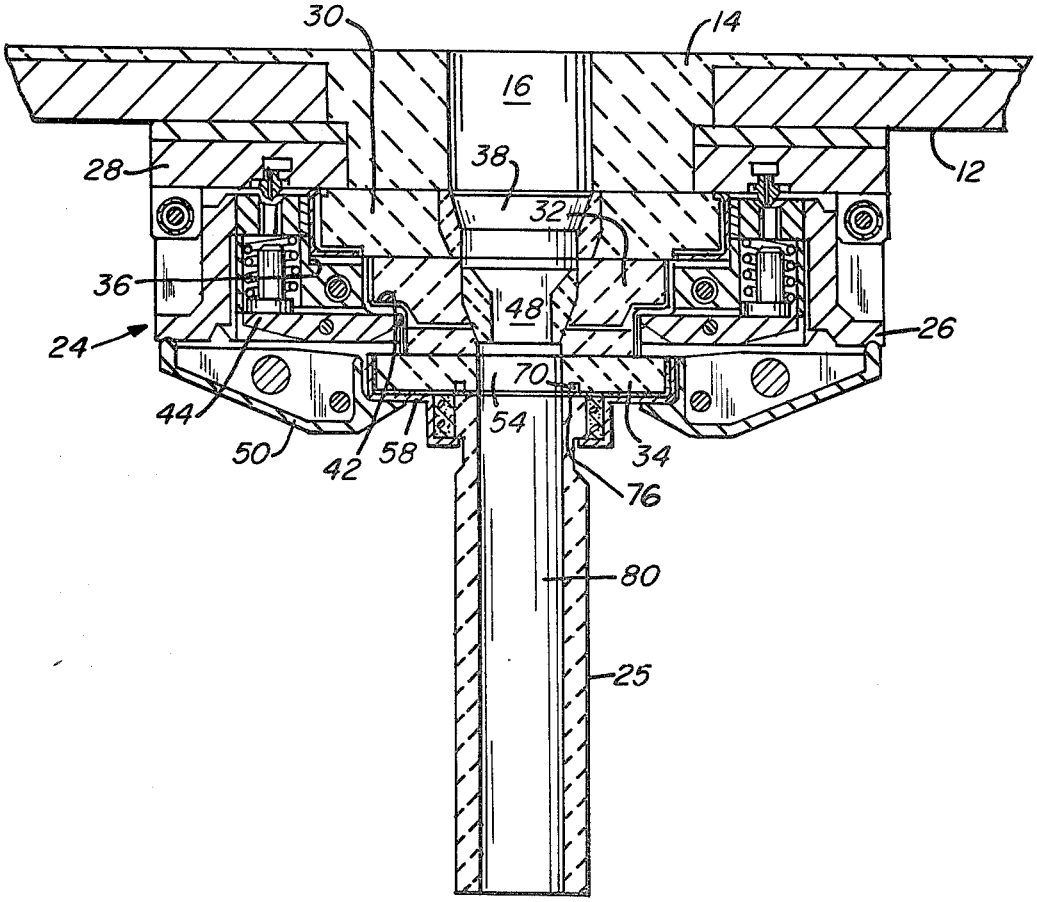
FIG. 2 is a cross-section on line 2—2 of FIG. 1.

As is well known, the gate plate 32 is adapted for sliding movement with respect to the stationary plate 30 under the urging of the fluid motor 46 shown in FIG. 1. The gate plate 32 illustrated in FIG. 2 is shown as being provided with a central opening 48 which, when vertically aligned with the opening 38 in the plate 30, permits flow of molten metal from the vessel 10. The plate 32 can be readily interchanged with other, similarly formed gate plates having central openings of greater or less diameter in order to vary the rate of metal flow from the vessel. A plate 32 containing a blank refractory is utilized when it is desired to prevent the flow of metal from the vessel.

The pouring tube support plate 34 is supported beneath the gate plate 32 by oppositely extending members 50 of a yieldable grid which permits ready replacement of the assembled pouring tube 25 and support plate 34. As shown best in FIG. 3 of the drawing, the tube support plate 34 of the present invention comprises a generally rectangular refractory block 52 having a central opening 54 for alignment with the opening 38 of the stationary plate 30. The block 52 is retained by means of mortar 56 or the like within a sheet metal casing 58 having upstanding sides 60, a bottom 62 and a downward extension 64 terminating in an interned flange 66 that serves to engage an annular recess 68 on the exterior wall of the pouring tube 25. Set screws 70 may be employed to secure the pouring tube 25 against lateral displacement with respect to the casing 58.

The undersurface of the refractory block 52 contains a central recess 68 concentric with the opening 54. The recess 68 is formed of a diameter adapted to freely receive the upper end of the pouring tube 25. Concentrically spaced between the opening 54 and the wall of the recess 68 the block is formed with an annular groove 70 that is caused to communicate with a gas supply fitting 72 attached to the bottom surface 62 of the casing 58 by means of an elongated passage 74. The gas supply fitting 72 is adapted for connection to a regulatable source (not shown) of gas, which may be an inert gas such as argon or a reducing gas.

Figure 3:
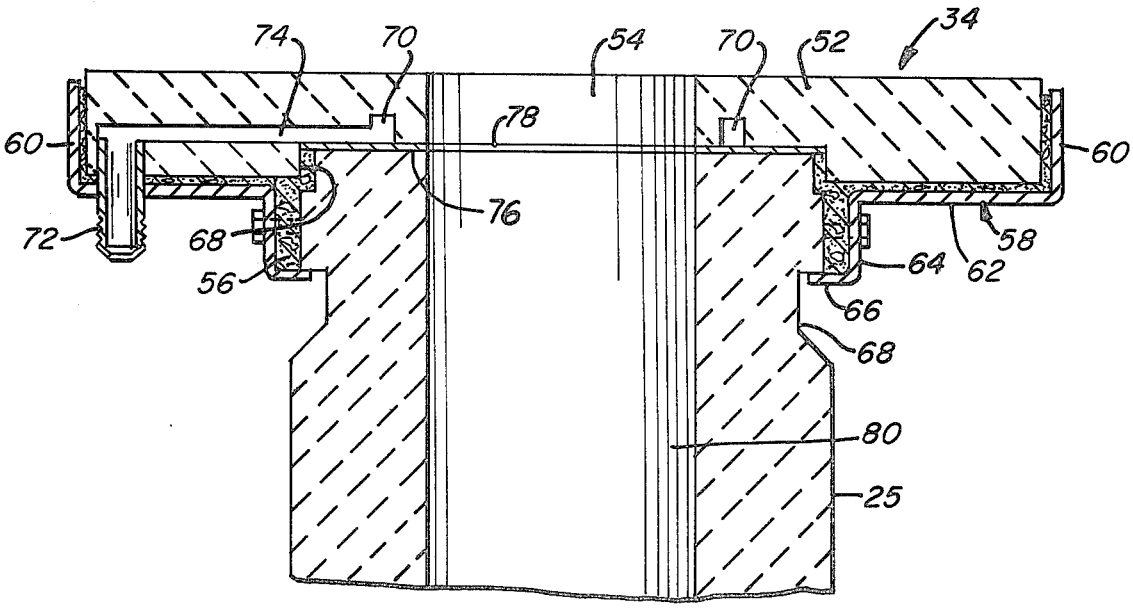
FIG. 3 is an enlarged sectional view of the pouring tube and tube support plate according to the present invention.

A thin metal shim 76 is interposed between the upper end of the pouring tube 25 and the facing surface of the recess 68. The shim 76, as shown in FIG. 3, has an outer peripheral dimension conforming closely to that of the recess wall and contains a central opening 78 interconnecting the opening 54 and the interior passage 80 of the pouring tube 25. The function of shim 76 is to baffle the flow of gas through passage 74 and into the groove 71 as hereinafter more fully explained.

In operation, the receiving vessel 10 is disposed with its bottom opening 16 located over the caster mold 18 such that the pouring tube 25 attached to the sliding gate valve 24 extends significantly into the interior of the mold. The gate plate 32 initially disposed in the valve 24 is a blank gate until such time as it is desired to initiate flow of metal from the vessel 10 into the mold 18 whereupon the blank gate plate is replaced by a gate plate having a central opening 48 as shown in the drawings herein. Replacement of the gate plates 32 is effected according to the procedure described in U.S. Pat. No. 3,727,805.

As the flow of molten metal commences to the mold 18, the metal level in the mold rises above the lower end of the pouring tube 25 thereby effecting a liquid seal between the interior of the tube and the atmosphere. When a predetermined liquid level is achieved in the mold, indicated as 81 in FIG. 1, the caster drive rolls 20 commence operation to withdraw formed product from the mold at a rate to maintain a substantially constant liquid level therein. If the sealing effectiveness of the sliding gate valve-pouring tube assembly is substantially absolute as is desirable, especially in order to prevent oxide occlusions when pouring aluminum-killed steels, continued flow of liquid metal through the pouring tube causes the air initially present in the tube to be exhausted therefrom by entrainment with the flowing metal. As the air is evacuated from the tube, a vacuum is created therein, particularly in the region adjacent the interface between the gate plate 32 and the tube support plate 34 and the liquid level in the pouring tube rises until the pouring tube is completely filled. When this occurs, the "superspeed effect" described hereinabove commences and the rate of flow of liquid metal through the pouring tube increases. This increase in liquid metal flow rate is manifested by a rise of the liquid level in the mold since the drive rolls 20 are rendered incapable of continuously maintaining the level constant when the "superspeed" phenomenon occurs. Thus, according to the invention, gaseous fluid, such as, for example, argon, is admitted in regulated amounts from the source to the annular groove 70 from whence it enters into the interior of the pouring tube through the pores of the refractory material forming the tube support block 52 but primarily through the interstices, indicated as 78 in FIG. 3, between the refractory block 52 and the metal shim 76. The flow of gas is maintained at a rate sufficient to retard the rate of liquid metal flow through the pouring tube such that drive rolls 20 can adequately maintain the level of liquid metal in the mold 18 substantially constant.

As gate plates 32 or support plates 34 with attached pouring tubes 25 are changed, it may be determined that the rate of flow of liquid metal through the pouring tube is reduced whereupon the rate of supply of gas to the system can be reduced to compensate for the changed system condition.

It will be understood that various changes in the details, materials and arrangements of parts which have been herein described and illustrated in order to explain the nature of the invention, may be made by those skilled in the art within the principle and scope of the invention as expressed in the appended claims.

We claim:

1. A pour tube assembly for subjacent attachment to a sliding gate valve organization for teeming molten metal comprising:

a refractory plate containing a through-opening and having an upper surface to accommodate relative sliding contact with a cooperating member of said sliding gate valve organization;

a lower surface on said plate spaced from, and parallel to, said plate upper surface and containing a recess having an annular wall concentrically spaced from said through-opening;

an annular groove formed in said plate lower surface concentrically disposed between said through-opening and said recess wall;

an elongated, generally cylindrical pour tube having an axial opening therethrough;

the upper end of said pour tube being received in said recess in underlying relation to said annular groove with its axial opening in registry with said plate through-opening to define a metal pour passage through said assembly;

a body of mortar sealingly disposed between the facing surfaces of said recess wall and said pour tube;

a flat shim containing an aperture registering with said metal pour passage received in said recess, said shim overlying the upper end of said pour tube and mortar body and underlying said annular groove to cooperatively define therewith an annular gas flow pass;

the facing surfaces of said shim and plate lower surface being in contact and defining an interstice extending between said annular gas flow pass and said metal pour passage; and means in said plate for connecting said gas flow pass to a gas source.

2. Apparatus as recited in claim 1 including a metal casing enclosing the side and bottom surfaces of said plate and including flange means for supporting said pour tube with respect to said plate;

a body of mortar sealingly disposed between the facing surfaces of said casing and said plate.

3. Apparatus as recited in claim 2 including a fitting attached to said casing for connecting said gas flow pass to a source of gas.

4. Apparatus as recited in claim 1 in which said shim is metallic.

* * * * *